US005584945A

United States Patent [19]

Nittel et al.

[11] Patent Number: 5,584,945

[45] Date of Patent: Dec. 17, 1996

[54] LUBRICANT CARRIER SALT FOR METAL FORMING

[75] Inventors: Klaus-Dieter Nittel, Frankfurt am Main; Norbert Schwinke-Kruse, Dreieich, both of Germany

[73] Assignee: Metallgesellschaft Aktiengesellschaft, Frankfurt am Main, Germany

[21] Appl. No.: 554,001

[22] Filed: Nov. 6, 1995

[30] Foreign Application Priority Data

Nov. 11, 1994 [DE] Germany ..... 44 40 301.1

[51] Int. Cl.[6] ..... C21D 7/02; C10M 111/02

[52] U.S. Cl. ..... 148/246; 72/42; 508/158; 508/199

[58] Field of Search ..... 252/49.3, 25; 72/42; 148/246

[56] References Cited

U.S. PATENT DOCUMENTS

| | | | |
|---|---|---|---|
| 23,184 | 12/1949 | Whitbeck . | |
| 2,588,234 | 3/1952 | Henricks . | |
| 2,921,874 | 1/1960 | Kubie . | |
| 2,957,825 | 10/1960 | Henricks . | |
| 2,958,659 | 11/1960 | Brown | 252/49.3 |
| 3,826,675 | 7/1974 | Smith | 148/246 |
| 4,138,348 | 2/1979 | Grasshoff . | |
| 5,074,972 | 12/1991 | Matz . | |
| 5,484,541 | 1/1996 | Przybylski et al. | 252/49.3 |

FOREIGN PATENT DOCUMENTS

| | | | |
|---|---|---|---|
| 0382155 | 8/1990 | European Pat. Off. | C10M 169/04 |
| 2341645 | 9/1977 | France | C10M 3/02 |
| 1594512 | 5/1970 | Germany | C10M 1/01 |
| 2330806 | 11/1975 | Germany | C10M 7/24 |
| 2003923 | 3/1979 | United Kingdom | C10M 7/02 |
| 1561836 | 3/1980 | United Kingdom | C10M 7/02 |

OTHER PUBLICATIONS

Oppen, D., "Chemische Oberflächenbehandlung als Mittel zur Erleichterung der Kaltumformung", Metall Oberfläche, Nov. 1982.

*Primary Examiner*—Sam Silverberg
*Attorney, Agent, or Firm*—Felfe & Lynch

[57] ABSTRACT

Disclosed is a lubricant carrier salt for facilitating the cold forming of a workpiece of iron or steel, based on boric acid and/or alkali borate. The salt has an additional content of aliphatic di- or tricarboxylic acid, which either is unsubstituted or substituted by at least one hydroxyl group, and/or of alkali salts thereof, the weight ratio of boric acid/alkali borate to the acid is (5 to 15):1. Especially appropriate carboxylic acids are malonic acid, maleic acid, succinic acid, tartaric acid and/or citric acid.

Inorganic or organic thickening agents, such as bentonite and/or polysaccharide, aluminate and/or silicate, dispersants, lubricants and/or antioxidants as well as titanium salt can be contained as additional components in the lubricant carrier salt of the invention.

Also disclosed is a method for facilitating the cold working of a workpiece of iron or steel, in which the lubricant carrier salt is applied to the workpiece, provided if desired with a phosphate coating, out of an aqueous solution or dispersion with a concentration of 5 to 30 wt-% and with a temperature of 80 to 100° C. by the immersion or pass-through method.

8 Claims, No Drawings

LUBRICANT CARRIER SALT FOR METAL FORMING

BACKGROUND OF THE INVENTION

The invention relates to a lubricant carrier salt to facilitate the cold forming of workpieces of iron or steel, based on boric acid and/or alkali borate, and to a method of facilitating the cold forming of workpieces of iron or steel with the aid of this lubricant carrier salt.

It is known to facilitate the cold forming of metal workpieces by the use of fatty acid salts (soaps). These are often applied in the form of a hot, aqueous soap solution to the workpiece that is to be formed. In many cases, especially when severe forming operations are to be performed, a chemical coating is applied to the metal surface before the application of the lubricant, namely a phosphate, oxide, oxalate or sulfide coating, for example. In both cases, i.e., in the application of the lubricant to the clean workpiece or to the workpiece previously provided with a chemical coating, the lubricant is to form a uniform film which will constitute a good parting layer between the workpiece and the tool during the forming treatment.

In addition to the application of soaps to clean workpieces or workpieces previously provided with a conversion coating, it is also known to use lubricants to facilitate cold forming, which are a mixture of fatty acid salts and alkali pyrophosphate and/or alkali tetraborate (DE-A-1 594 512). Part of the soaps are to be fatty acid salts of lithium, potassium, ammonium, calcium, magnesium, zinc and/or aluminum.

Also lubricants are known which consist of neutral fat and/or oil, alkali metal soaps, and alkali metal salt of boric acid (DE-B-23 30 806), contain alkali borate, alkali sulfate and silicate, as well as chloride (GB 1561 836), or else have a content of watersoluble metal soap, alkali metal chloride, alkali metal sulfate and alkali metal borate (GB-A-2 003 923).

It is furthermore known to apply to a metal workpiece a so-called lubricant carrier salt, which does not itself act as a lubricant, but is subjected to an after-treatment, e.g., by application of soap on the drawing machine. Examples of such lubricant carrier salts are lime ($Ca(OH)_2$), iron hydroxide ($Fe(OH)_2$), and borax ($Na_2B_4O_7.10\ H_2O$) (D. Oppen, "Chemisehe Oberflächenbehandlung als Mittel zur Erleichterung der Kaltumformung," Metalloberflfiche (1982), pages 566 ff).

Especially borax permits a high drawing speed, but its hygroscopicity is a disadvantage, so that the drawing quality of the wire, for example, decreases and rusting can be found on the wire surface. The loss of drawing quality is caused by the loss of adhesion connected with the increasing moisture absorption. Another problem lies in the drying that follows. If, for example, the wire is overdried, i.e., if the water of crystallization is wholly or even partially driven out of the applied borax, the borax coating loses its adhesion to the wire. The drawing quality is thus no longer good.

THE INVENTION

The present invention addresses the problem of devising a lubricant carrier salt on the basis of boric acid and/or alkali borate, to facilitate the cold forming of a workpiece of iron or steel, which does not have the disadvantages of the known lubricant carrier salt, is especially insensitive to the drying process, and after application is but slightly, or not at all, hygroscopic.

The problem is solved according to the invention by improving the lubricant carrier salt of the kind referred to above in such a manner that it has a content of aliphatic di- or tricarboxylic acid, which either is not substituted or is substituted by at least one hydroxyl group, and/or an alkali salt therefore, the weight ratio of boric acid/alkali borate (reckoned as $H_3BO_3$) to carboxylic acid (reckoned as citric acid) amounting to (5 to 15):1.

The expression used above, "aliphatic di- or tricarboxylic acid, which either is not substituted or is substituted by at least one hydroxyl group," means that the carboxylic acid must have at least one $CH_2$ or CH group that can be substituted.

Especially appropriate di- and tricarboxylic acids are malonic acid, maleic acid, succinic acid, tartaric acid and/or citric acid. In particular, the carboxylic acids used in the lubricant carrier salt of the invention should have a melting point above 100° C.

In order to set the film thickness of the applied lubricant carrier salt within specific limits, an additional advantageous embodiment of the invention provides for the use of a lubricant carrier salt which has an additional content of an inorganic or organic thickening agent, preferably in an amount of 0.5 to 5 wt.-% (with respect to the finished lubricant carrier salt). Bentonite and/or polysaccharides are especially suitable thickening agents.

Another advantageous embodiment of the invention consists in applying a lubricant carrier salt which has an additional content of aluminate and/or silicate, preferably metasilicate and/or disilicate, in an amount of 1 to 10 wt.-% (with respect to the finished lubricant carrier salt). This embodiment causes the lubricant carrier salt applied to the workpiece to have a defined roughness, and thus a defined amount of lubricant is carried to the forming tool.

Lastly, it is advantageous to apply to the workpiece a lubricant carrier salt which has an additional content of dispersants, agents for reducing friction and wear, and/or corrosion inhibitors, preferably soap, in a total amount of 2 to 15 wt.-% (with respect to the finished lubricant carrier salt) and/or an additional content of titanium salt, preferably titanium phosphate, in an amount of 10 to 100 milligrams (calc. or reckoned as Ti) kilogram of lubricant carrier salt. The special advantages of such additives is that contact between the workpiece and the tool is effectively prevented.

The lubricant carrier salts according to the invention are usually applied in the form of an aqueous solution or dispersion to the workpiece. Accordingly a component of the invention is a method for facilitating the cold forming of a workpiece of iron or steel wherein the lubricant carrier salt is applied out of an aqueous solution or dispersion with a concentration of 5 to 30 wt.-% and with a temperature of 80° to 100° C. by an immersion or pass-through process.

The application of the lubricant carrier salt can be made to the clean metal surface. However, it is especially expedient, according to an additional advantageous embodiment of the method of the invention, to provide the workpiece of iron or steel with a phosphate coating prior to the application of the lubricant carrier salt. In this manner contact between workpiece and tool, e.g., in the case of multiple draws, is effectively prevented.

The invention is especially advantageous for wire drawing, cold heading, cold forging and ironing. Its special advantages are that the lubricant carrier salt applied to the workpiece is insensitive to over-drying and has virtually no hygroscopic properties. The maximum moisture absorption after drying amounts to 2% by weight.

The invention will be further explained by means of the following examples.

EXAMPLE 1

A lubricant carrier salt was used which had the following components:

50 wt-% boric acid ($H_3BO_3$);

15 wt-% potassium borate ($K_2B_4O_7.4H_2O$);

10 wt-% sodium borate (Neobor, $Na_2B_4O_7.5H_2O$);

5 wt-% sodium disilicate ($Na_2Si_2O_5.xH_2O$);

10 wt-% citric acid; and 10 wt-% sodium stearate.

A 15 wt-% aqueous solution was prepared from the above lubricant carrier salt and coils of steel wire were treated by immersion therein for ten minutes at a temperature of 90° C. The immersion treatment was followed by drying at 150° C. in a circulating air oven. As a result of this preliminary treatment the steel wire had a lubricant carrier salt coating with a weight of 6 g/m$^2$. After soap had been applied ahead of the drawing die, the wire, which had an initial diameter of 5.5 mm, was reduced by eight draws at a drawing speed of 8 m/sec to a final diameter of 1.9 mm. These results were obtained repeatably for different storage times and occasional overdrying of the wire coated with the lubricant carrier salt.

EXAMPLE 2

For the preparation of, again, steel wires, a lubricant carrier salt was used which contained the following components:

40 wt-% boric acid ($H_3BO_3$);

35 wt-% potassium borate ($K_2B_4O_7.4H_2O$);

2.9 wt-% sodium disilicate ($Na_2Si_2O_5.xH_2O$);

10 wt-% citric acid;

0.1 wt-% titanyl sulfate;

5 wt-% polysaccharide; and 7 wt-% potassium oleate.

Before applying the lubricant carrier salt the steel wire was freed of rust and scale by immersion with the aid of hydrochloric acid, and after thorough rinsing with water, the wire was phosphatized at 45° C. for 6 to 10 minutes. The composition of the phosphatizing solution was:

10.9 g/l zinc;

2.1 g/l manganese;

2.0 g/l iron(II);

0.5 g/l calcium;

0.5 g/l nickel;

0.01 g/l copper;

0.3 g/l sodium;

24.0 g/l nitrate;

10.6 g/l phosphate (reckoned as $P_2O_5$);

1.6 g/l tetrafluoroborate;

1.6 g/l tartaric acid; and 0.5 g/l urea.

The weight per unit area of the phosphate coating produced by the phosphatizing solution amounted to 10 gm$^2$.

The application of the lubricant carrier salt was made out of a 25 wt-% solution, heated to 90° C., by the continuous pass-through method, wherein the time of contact between the steel wire and the solution of the lubricant carrier salt was 15 seconds. The lubricant carrier salt applied in this manner had a weight of 4 g/m$^2$.

Then, after the application of soap ahead of the drawing die, the steel wire was reduced by six draws at 6 m/see from an initial 6 mm to 3.5 min. Here, again, repeatable results were obtained with different storage times and occasional overdrying.

It will be understood that the specification and examples are illustrative but not limitative of the present invention and that other embodiments within the spirit and scope of the invention will suggest themselves to those skilled in the art.

We claim:

1. A method for facilitating a cold forming comprising: applying to a workpiece of iron or steel a lubricant carrier salt wherein said lubricant carrier salt comprises boric acid and/or alkali borate, aliphatic di- or tricarboxylic acid which is either unsubstituted or substituted by at least one OH group, and/or of alkali salts thereof, wherein the weight ratio of boric acid and/or alkali borate, calculated as $H_3BO_3$, to carboxylic acid, calculated as citric acid, is about (5 to 15):1 and said salt is applied from an aqueous solution or dispersion with a concentration of 5 to 30 wt- %: and, applying a soap to the workpiece.

2. The method of claim 1 wherein the solution or dispersion is at a temperature of 80° to 100° C.

3. The method of claim 2 wherein the solution or dispersion is applied by an immersion or pass-through technique.

4. The method of claim 1, further comprising forming a phosphate coating on the workpiece prior to the application of the lubricant carrier salt.

5. The method of claim 1 wherein the acid is at least one selected from the group consisting of malonic acid, maleic acid, succinic acid, tartaric acid and citric acid.

6. The method of claim 1 wherein the lubricant carder salt further comprises aluminate and/or silicate, in an amount of 1 to 10 wt-% with respect to the completed lubricant carder salt.

7. The method of claim 1 wherein the workpiece to which the lubricant carrier salt is applied is subjected to a drying step.

8. The method of claim 1 further comprising cleaning the workpiece prior to applying the lubricant carrier salt.

* * * * *